US005395687A

United States Patent [19]

Totsuka et al.

[11] Patent Number: 5,395,687

[45] Date of Patent: Mar. 7, 1995

[54] SURFACE-TREATED ALUMINUM MATERIAL HAVING IMPROVED SPOT RESISTANCE WELDABILITY, WORKABILITY, AND CORROSION RESISTANCE

[75] Inventors: Nobuo Totsuka; Naoki Nishiyama; Yasuji Uesugi; Masaki Mabuchi; Kouichi Hashiguchi; Rinsei Ikeda; Koji Yamato, all of Chiba; Motohiro Nabae, Nikko, all of Japan

[73] Assignees: Kawasaki Steel Corporation; Furukawa Aluminum Co., Ltd., both of Japan

[21] Appl. No.: 20,052

[22] Filed: Feb. 19, 1993

[30] Foreign Application Priority Data

Feb. 24, 1992 [JP] Japan ..... 4-036345
Apr. 1, 1992 [JP] Japan ..... 4-079839
Nov. 30, 1992 [JP] Japan ..... 3-320425

[51] Int. Cl.[6] ..... B32B 15/08

[52] U.S. Cl. ..... 428/327; 428/323; 428/328; 428/330; 428/336; 428/341; 428/469

[58] Field of Search ..... 428/423.1, 457, 458, 428/623, 626, 421, 546, 551, 556, 650, 666, 461, 323, 328, 327, 330, 336, 341, 651, 460, 469

[56] References Cited

U.S. PATENT DOCUMENTS 4,186,036 1/1980 Elms et al. ..... 148/6.15 R
5,059,492 10/1991 Shindou et al. ..... 428/625
5,061,575 10/1991 Mohri et al. ..... 428/623
5,106,675 4/1992 Ara et al. ..... 428/457 X

FOREIGN PATENT DOCUMENTS 0344717 6/1989 European Pat. Off. .
0390122 3/1990 European Pat. Off. .
0385448 5/1990 European Pat. Off. .

*Primary Examiner*—Paul J. Thibodeau
*Assistant Examiner*—Stephen Sand
*Attorney, Agent, or Firm*—Bierman and Muserlian

[57] ABSTRACT

A surface-treated aluminum material comprising an aluminum or aluminum alloy substrate, a chromate film deposited on the substrate, and an organic resin mixture film deposited on the chromate film is provided. The chromate film is deposited to a coating weight of from 5 to 100 mg/m$^2$ calculated in terms of elementary chromium on the aluminum substrate. The organic resin mixture film is deposited to a dry film thickness of from 0.05 to 3.0 μm, and comprises (a) 100 parts by weight of an organic resin, (b) 0.5 to 40 parts by weight of a powder lubricant having an average particle size of from 0.05 to 20 μm, said average particle size being in the range of from 1.0 to 10 folds of the dry film thickness, and (c) 1.0 to 40 parts by weight of electroconductive finely divided particles having an average particle size in the range of from 0.05 to 5 μm, said average particle size being in the range of from 1.0 to 2 folds of the dry film thickness. The organic surface-treated aluminum material has remarkable weldability, workability as well as corrosion resistance.

4 Claims, No Drawings

SURFACE-TREATED ALUMINUM MATERIAL HAVING IMPROVED SPOT RESISTANCE WELDABILITY, WORKABILITY, AND CORROSION RESISTANCE

BACKGROUND OF THE INVENTION

This invention is directed to a surface-treated aluminum material which may be used in such application as automobiles, electric appliances, cans, and the like, wherein the aluminum materials are inevitably subjected to press-working and spot resistance welding. More particularly, this invention is directed to a surface-treated aluminum material which is provided with remarkably improved workability, spot weldability, and corrosion resistance.

Recently, it has become an emergent issue to reduce weight of automobile chassis to thereby improve fuel efficiency and reduce $CO_2$ exhaustion, as strongly appreciated in view of global environment, and in particular, in view of preventing warming of the earth. Under such conditions, use of an aluminum alloy for automobile chassis have attracted a considerable attention because of reliability and workability, as well as reusability of the material. Use of an aluminum alloy plate for automobile chassis, therefore, has only recently been started.

Aluminum materials are also used for electric appliances, office automation equipments, building materials, can materials, and other applications. In the production of such products, aluminum materials are also subjected to frequent press-working as well as spot welding.

Aluminum materials are markedly inferior to steel materials in their spot resistance weldability, in particular, with regard to the life of the welding electrode employed, inevitably resulting in a reduced productivity of the final products including the automobile chassis, whose production may involve repeated spot welding.

More illustratively, spot welding of an aluminum or an aluminum alloy plate is likely to be accompanied with deposition of molten aluminum on the electrode. Furthermore, the number of spot welds with an adequate nugget diameter that could be made with one electrode is significantly small compared to the spot welding of steel plates. Therefore, a frequent dressing or replacement of the welding electrode was required to prevent such deposition of the molten aluminum on the electrode and excessive reduction in the nugget diameter, and such a frequent dressing or replacement of the electrode adversely affected the welding efficiency of the aluminum or aluminum alloy plates, and hence, productivity of the final product.

Since it is only of comparatively recent date that an aluminum or an aluminum alloy plate is utilized in an industrial scale production wherein spot resistance welding is involved, there are only few adequate proposals for overcoming the above-described problems. Japanese Patent Application Kokai No. 60(1985)-187483 proposes an improvement by adequately controlling the thickness of the oxide film on the welding surface of the aluminum plate by means of an anodic treatment. Japanese Patent Application Kokai Nos. 53(1978)-6252, 53(1978)-48954 and 53(1978)-48955 disclose an improvement by disposing a zinc, titanium or stainless steel thin film between the welding surfaces of the aluminum or aluminum alloy plates; and Japanese Patent Application Kokai No. 57(1983)-4389 discloses an improvement by providing a chromium, nickel, copper or silver-plated layer on the aluminum or aluminum alloy plate; although these are not specifically developed for the aluminum alloy plates adapted for automobile uses.

Of the above-described proposals, the anodic treatment for controlling the oxide film thickness is difficult to consistently carry out, rendering the process unreliable and unpractical. The provision of the zinc, titanium or stainless steel thin film between the welding surfaces of the aluminum alloy plates is inadequate for the aluminum alloy plates for automobile use. The provision of the chromium, nickel, copper or silver-plated layer on the aluminum alloy plate is unpractical since the adhesion of the plated layer to the aluminum alloy substrate is insufficient.

Compared to steel materials, an aluminum or an aluminum alloy is soft and poor in tensile properties, and therefore, die galling is frequently induced in the press-working of such a material.

In press-working of the aluminum or aluminum alloy plates, a lubricating oil is usually applied on the surface of the plate. Such application of the lubricating oil, however, suffered from various problems including:

(1) die galling in the press-working could not be prevented by simply applying the lubricating oil;

(2) the lubricating oil is usually applied by spraying, which resulted in spreading of the lubricating oil to adversely affect the working conditions; and (3) degreasing/washing step after the press-working was inevitable before the product could be assembled with other products, and such degreasing-/washing involved use of a hazardous solvent such as a chlorofluorocarbon or 1-1-1-trichloroethane which adversely affected the working conditions and arose environmental problems.

Therefore, there is a demand for an aluminum plate material which could be press-worked without application of a lubricating oil and which does not require degreasing step after the press-working of the material. Japanese Patent Application No. 2(1990)-310036 and 3(1991)-180218 disclose a wax-coated aluminum plate, which has been developed as a can material. This material, however, suffers from difficulty in the control of the coating weight of the wax. When the coating weight of the wax is excessively small, this material exhibits poor workability, while an excessively large coating weight of the wax results in contamination of the mold. Therefore, such a can material could only be used for limited applications. This material also suffers from an insufficient corrosion resistance when the material is used without any post-treatments, since the surface of the aluminum plate would become exposed after the press-working of the material. Such an application of the solid lubricant also results in a reduced spot weldability, which is another serious problem.

It was quite difficult to achieve stable effects under different working conditions by such conventional process wherein the workability is improved by the wax application. Furthermore, such conventional process required an anti-corrosion treatment such as coating after the press-working to prevent rust from developing under some conditions. Therefore, it was quite difficult to omit the washing step after the press-working or use of the lubricating oil in the press-working.

Although an aluminum or an aluminum alloy plate is inherently provided with an excellent corrosion resistance, it was the oxide film formed on the surface of the plate which was responsible for such an excellent corrosion resistance. Therefore, when an aluminum or an aluminum alloy plate is subjected to spot welding or press-working and crevices or hems are formed wherein no such oxide film is present, a so-called crevice corrosion is likely to be induced in such hems and crevices.

SUMMARY OF THE INVENTION

In view of the above-described situations, an object of the present invention is to provide an aluminum or an aluminum alloy material which has obviated the above-described problems. Another object of the present invention is to provide an aluminum or an aluminum alloy material which has a sufficient spot weldability so that the electrode life in spot welding would be prolonged to increase the number of welds that can be made with one electrode. A further object of the present invention is to provide an aluminum or an aluminum alloy material which has a remarkably improved press-workability compared to conventional aluminum materials so that the material may be reliably produced in an industrial scale at low cost without using any lubricating oil in the press-working. A still further object of the present invention is to provide an aluminum or an aluminum alloy material which has an improved corrosion resistance, in particular, an improved crevice corrosion resistance. Other objects and advantages of the invention will be appreciated by the following description of the invention.

The improvement in spot weldability has been attained on the bases of the findings as described below. When an aluminum alloy plate is repeatedly subjected to spot resistance welding using a copper-based electrode, diameter of the electrode tip through which welding current passes increases in accordance with the number of spot welds that had been made, and the current density within the aluminum alloy plate being welded would become reduced in accordance with the increase in the electrode diameter to result in a reduced nugget diameter. The rate of increase in the diameter of the welding electrode in the case of aluminum alloy plate welding is uniquely high, and therefore, the life of the welding electrode is unduly short compared to the welding of steel plates.

The inventors of the present invention have made an intensive investigation on such a phenomenon in order to find out a solution therefor, and found out that when the aluminum alloy plates are repeatedly spot welded, molten aluminum alloy would become deposited on the tip of the welding electrode through which the welding current passes, and an oxide of such a molten aluminum alloy would serially deposit one after another as the spot welding is repeated and the thus formed deposit would finally constitute an insulation layer to induce sparks between the insulation layer and the electrode. The electrode would become randomly eroded by such sparks. It has also been found that a rapid welding of the aluminum alloy plates is inhibited by the oxide film on the welding surface of the aluminum alloy plate, which insulates the electric current. The inventors concluded that the phenomena as described above which are unique to the aluminum alloy plates promote the increase in the diameter of the welding electrode tip to result in an extremely short life of the welding electrode.

On the bases of the above findings, it was estimated that, for improving the spot weldability, it would be quite effective to decrease the area of contact between the electrode and the aluminum alloy plate and to secure a sufficient welding current, and it has been found that an application of a resin layer containing electroconductive particles therein on the surface of the aluminum alloy plate is effective for improving the spot weldability.

It was also found that a considerable amount of heat could be generated by depositing a sufficient amount of chromate on the welding surface of the aluminum substrate to thereby facilitate the spot welding while the amount of heat generated on the side on which the welding electrode is disposed could be suppressed by reducing the amount of the chromate deposited on this side of the aluminum substrate to a level lower than that of the chromate deposited on the welding surface of the aluminum substrate to thereby prevent the deposition of the molten aluminum on the welding electrode.

The improvement in press-workability has been attained on the bases of the findings as described below. Although improvement in tensile properties is the most fundamental solution for improving the press-workability, the inventors of the present invention found out that the press-workability of an aluminum alloy plate could be improved to a certain degree by increasing the surface lubricity of the substrate surface, and the surface lubricity may be improved by disposing a resin layer containing a lubricant on the substrate surface.

It was also found that the provision of the chromate film and the resin layer is effective in protecting the surface of the aluminum or aluminum alloy substrate, in particular, the part of the surface which had become exposed by the spot welding or press-working, and therefore, in improving the corrosion resistance of the product.

The inventors of the present invention have completed the present invention on the bases of the above-described findings.

According to first aspect of the present invention, there is provided a surface-treated aluminum material having improved spot resistance weldability, workability and corrosion resistance comprising (A) an aluminum or aluminum alloy substrate;

(B) a chromate film deposited on the substrate to a coating weight of from 5 to 100 mg/m$^2$ calculated in terms of elementary chromium on the first major surface; and (C) an organic resin mixture film deposited on the chromate film to a dry film thickness of from 0.05 to 3.0 μm, said organic resin mixture film comprising (a) 100 parts by weight of an organic resin, (b) 0.5 to 40 parts by weight of a powder lubricant having an average particle size of from 0.05 to 20 μm, said average particle size being in the range of from 1.0 to 10 folds of the dry film thickness, and (c) 1.0 to 40 parts by weight of electroconductive finely divided particles having an average particle size in the range of from 0.05 to 5 μm, said average particle size being in the range of from 1.0 to 2 folds of the dry film thickness.

According to second aspect of the invention, there is provided a surface-treated aluminum material having improved spot resistance weldability, workability with no lubricant oil and corrosion resistance comprising (A) an aluminum or aluminum alloy substrate;

(B) a chromate film deposited on the substrate to a coating weight of from 5 to 100 mg/m$^2$ calculated in terms of elementary chromium on the first major surface; and (C) an organic resin mixture film deposited on the chromate film to a dry film thickness of from 0.05 to 3.0 μm, said organic resin mixture film comprising (a) 100 parts by weight of an organic resin, (b) 2 to 40 pares by weight of a powder lubricant having an average particle size of from 0.05 to 20 μm, said average particle size being in the range of from 1.0 to 10 folds of the dry film thickness, and (c) 1.0 to 40 parts by weight of electroconductive finely divided particles having an average particle size in the range of from 0.05 to 5 μm, said average particle size being in the range of from 1.0 to 2 folds of the dry film thickness.

According to third aspect of the invention, there is provided a surface-treated aluminum material having improved spot resistance weldability, workability and corrosion resistance comprising (A) an aluminum or aluminum alloy substrate;

(B) a chromate film deposited on the substrate to a coating weight of from 5 to 100 mg/m$^2$ calculated in terms of elementary chromium on the first major surface; and (C) an organic resin mixture film deposited on the chromate film to a dry film thickness of from 0.05 to 3.0 μm, said organic resin mixture film comprising (a) 100 parts by weight of an organic resin, (b) 0.5 to 20 parts by weight of a powder lubricant having an average particle size of from 0.05 to 20 μm, said average particle size being in the range of from 1.0 to 10 folds of the dry film thickness, and (c) 1.0 to 40 parts by weight of electroconductive finely divided particles having an average particle size in the range of from 0.05 to 5 μm, said average particle size being in the range of from 1.0 to 2 folds of the dry film thickness.

The organic resin may preferably be at least one member selected from the group consisting of epoxy resins, alkyd resins, acryl resins, urethane resins, phenol resins, melamine resins, polyvinyl butyral resins, polyester resins, and copolymers thereof. The base resin may further include conventional additives such as a reaction promoter, a stabilizer, and a dispersant in an amount that does not detract from the purpose of the present invention.

The powder lubricant may preferably be at least one member selected from the group consisting of polyolefin waxes and fluororesins.

The electroconductive finely divided particles may preferably be at least one member selected from the group consisting of copper, nickel, silver, aluminum, zinc, chromium, iron, cobalt, alloys thereof, and carbon graphite.

The chromate layer may preferably be deposited on the surface of the substrate on which the welding electrode is to be disposed in spot welding to a coating weight equal to or smaller than $\frac{3}{4}$, more preferably $\frac{1}{2}$, of the coating weight of the chromate layer on the surface of the substrate to be welded.

Another embodiments of the present invention there are provided:

a surface-treated aluminum material having improved spot resistance weldability and workability comprising (A) an aluminum or aluminum alloy substrate;

(B) a chromate film deposited on the substrate to a coating weight of from 5 to 100 mg/m$^2$ calculated in terms of elementary chromium on the first major surface; and (C) an organic resin mixture film deposited on the chromate film to a dry film thickness of from 0.05 to 3.0 μm, said organic resin mixture film comprising (a) 100 parts by weight of an organic resin, (b) 0.5 to 20 parts by weight of a powder lubricant having an average particle size of from 0.05 to 10 μm, said average particle size being in the range of from 1.0 to 10 folds of the dry film thickness, and (c) 1.0 to 40 parts by weight of electroconductive finely divided particles having an average particle size in the range of from 0.05 to 5 μm, said average particle size being in the range of from 1.0 to 2 folds of the dry film thickness;

a surface-treated aluminum material having improved spot resistance weldability and workability with no lubricant oil comprising (A) an aluminum or aluminum alloy substrate;

(B) a chromate film deposited on the substrate to a coating weight of from 5 to 100 mg/m$^2$ calculated in terms of elementary chromium on the first major surface; and (C) an organic resin mixture film deposited on the chromate film to a dry film thickness of from 0.05 to 3.0 μm, said organic resin mixture film comprising (a) 100 parts by weight of an organic resin, (b) 2 to 40 parts by weight of a powder lubricant having an average particle size of from 0.05 to 20 μm, said average particle size being in the range of from 1.0 to 10 folds of the dry film thickness, and (c) 1.0 to 40 parts by weight of electroconductive finely divided particles having an average particle size in the range of from 0.05 to 5 μm, said average particle size being in the range of from 1.0 to 2 folds of the dry film thickness;

a surface-treated aluminum material having improved spot resistance weldability, workability and corrosion resistance comprising (A) an aluminum or aluminum alloy substrate;

(B) a chromate film deposited on the substrate to a coating weight of from 5 to 100 mg/m$^2$ calculated in terms of elementary chromium on the first major surface; and (C) an organic resin mixture film deposited on the chromate film to a dry film thickness of from 0.05 to 3.0 μm, said organic resin mixture film comprising (a) 100 parts by weight of an organic resin having hydroxyl and/or carboxyl group (b) 0.5 to 20 parts by weight of a powder lubricant having an average particle size of from 0.05 to 10 μm, said average particle size being in the range of from 1.0 to 10 folds of the dry film thickness, and (c) 1.0 to 40 parts by weight of electroconductive finely divided particles having an average particle size in the range of from 0.05 to 5 μm, said average particle size being in the range of from 1.0 to 2 folds of the dry film thickness, wherein the aluminum substrate has one surface on which welding electrode is to be disposed upon spot welding and the other surface which is to be welded with another material, and the chromate layer (B) is deposited, or optionally is not deposited, on the surface on which the welding electrode is to be disposed to a coating weight equal to or smaller than $\frac{3}{4}$ of the coating weight of the chromate layer (B) on the surface to be welded.

DETAILED DESCRIPTION OF THE INVENTION

The surface-treated aluminum material of the present invention comprises an aluminum or aluminum alloy substrate, a chromate layer on the substrate, and an organic resin mixture film on the chromate layer.

Aluminum substrate

The substrates which may be used in the present invention include conventional aluminum and aluminum alloy materials used for automobiles, home appliances, building materials, cans and the like, which are conventionally subjected to press-working and spot resistance welding. Such an aluminum substrate may comprise aluminum or a spot-weldable alloy of aluminum with at least one metal selected from the group consisting of Cu, Mn, Mg, Zn, Si, Zr, Fe, Cr, and Li. The substrate may have any configuration, and may be a plate, rod, tube or the like.

Before subjecting the aluminum or aluminum alloy substrate to subsequent chromate treatment, an inconsistent oxide layer formed on the substrate in the process of its production may be removed in order to form a consistent chromate film.

Chromate layer

On at least one major surface of the aluminum or aluminum alloy substrate is deposited the chromate layer. The chromate film deposited on the substrate will provide (i) a sufficient resistance heat upon application of an electric current, (ii) a fair corrosion resistance, and in particular, a fair crevice corrosion resistance after welding, as well as (iii) satisfactory adhesion with the overlying organic resin mixture film. The chromate may be deposited on the substrate to a coating weight calculated in terms of elementary chromium of from 5 to 100 mg/m$^2$, and more preferably to a coating weight of from 10 to 50 mg/m$^2$. When the coating weight on the surface of the substrate is less than 5 mg/m$^2$, there will remain some parts on the substrate where no chromate is deposited, and such an inconsistent deposition of the chromate is unfavorable in view of the corrosion resistance as well as adhesion with the overlying layer. A chromate film deposited on the substrate to a coating weight in excess of 100 mg/m$^2$ would not provide any further remarkable improvement in the corrosion resistance and therefore, would be uneconomical. Such a thick chromate film may also result in an unduly increased insulation resistance detracting from welding stability and adaptability to electrodeposition coating.

The chromate layer may not necessarily be deposited on both major surfaces of the aluminum or aluminum alloy substrate. The substrate, however, may preferably have the chromate layer on both sides for improving the adhesion with the overlying organic resin mixture film and for preventing the deposition of the molten aluminum matrix with the electrode upon welding.

When the chromate layer is deposited on one major surface of the aluminum substrate to a coating weight equal to or smaller than $\frac{3}{4}$, more preferably $\frac{1}{2}$, of the coating weight of the chromate layer on the other major surface of the substrate, and the welding electrode is disposed on the side of the substrate with the smaller coating weight, it would be possible to generate a larger amount of heat on the surface of the substrate to be welded compared to the amount of heat generated on the side of the electrode, to thereby improve the weldability.

The chromate layer may be deposited by either conversion type-chromate, dry in place type-chromate, or electrolytic chromate treatment, among which the former two types of treatments being preferred in view of the consistency of the chromate film formed.

Organic resin mixture film

On the chromate layer is formed the organic resin mixture film comprising an organic resin, a powder lubricant, and electroconductive finely divided particles.

The organic resin mixture film is deposited to a dry film thickness of from 0.05 to 3.0 μm. An organic resin mixture film deposited to a dry film thickness of less than 0.05 μm would not induce any improvement in workability. An excessively thick film with a dry film thickness of more than 3.0 μm may result in an increased electric resistance to detract from spot weldability, or in a partial peeling off of the film upon press-working to detract from workability. The organic resin mixture film having the dry film thickness of from 0.05 to 3.0 μm will provide an improved lubricating properties without any reduction in spot weldability or peeling off of the film upon press-working. The dry film thickness of the organic resin mixture film may more preferably be from 0.1 to 1.0 μm.

The organic resins which may be employed in the present invention include epoxy resins, alkyd resins, acryl resins, urethane resins, phenol resins, melamine resins, polyvinyl butyral resins, and polyester resins, which facilitate a sufficient adhesion with the underlying substrate. The resins may be used either alone or in combination of two or more.

The powder lubricant may be a polyolefin wax, a fluororesin, or a mixture thereof.

Exemplary polyolefin waxes include polyethylene wax, polypropylene wax, and polybutene wax.

Exemplary fluororesins include polyethylene tetrafluoride resin, polyvinyl fluoride resin, and polyvinylidene fluoride.

The powder lubricant may have an average particle size of from 0.05 to 20 μm, and preferably from 0.1 to 10 μm. The average particle size of the powder lubricant may preferably be from 1.0 to 10 folds of the dry film thickness of the organic resin mixture film.

When the powder lubricant has an excessively small average particle size in relation to the dry film thickness, lubricity of the product would not be sufficiently improved. An excessively large average particle size in relation to the dry film thickness, on the other hand, would result in falling off of the lubricant particles from the organic resin mixture film. A more preferable range of the average particle size is from 1.5 to 5 folds of the dry film thickness.

The powder lubricant may be added to the coating composition in an amount of from 0.5 to 40 parts by weight per 100 parts by weight of the organic resin. When the amount of the powder lubricant is less that 0.5 parts by weight per 100 parts by weight of the organic resin, the lubricity, and hence the workability of the product would not be sufficiently improved. An addition of more than 40 parts by weight of the powder lubricant per 100 parts by weight of the organic resin is accompanied with the risk of an incomplete cohesion of the resin, which may induce powdering of the resin mixture film to detract from corrosion resistance.

It is to be noted that, to provide a sufficient lubricity with the product even when the product is press-worked with no lubricating oil, an addition of the powder lubricant in an amount of more than 2 parts by weight, and therefore, in the range of from 2 to 40 pares by weight per 100 parts by weight of the organic resin would be desirable. When the product is to be press-worked using a lubricating oil, it would be desirable to incorporate 0.5 to 20 parts by weight of the powder lubricant per 100 parts by weight of the organic resin since the lubricant in an amount of more than 20 parts by weight may promote penetration of the oil into the resin mixture film to loosen cohesion of the organic resin.

The electroconductive finely divided particles may preferably be a metal such as copper, nickel, silver, aluminum, zinc, chromium, iron, or cobalt; an alloy thereof; carbon graphite; or a mixture thereof.

The electroconductive finely divided particles may have an average particle size of from 0.05 to 5 μm, and more preferably, from 0.1 to 2 μm. Preferably, the average particle size of the electroconductive finely divided particles may be in the range of from 1.0 to 2 folds of the dry film thickness of the organic resin mixture film.

When the electroconductive finely divided particles has an excessively small average particle size in relation to the dry film thickness, electroconductivity of the product would not be sufficiently improved. An excessively large average particle size of the electroconductive finely divided particles in relation to the dry film thickness, on the other hand, would adversely affect the workability. In particular, when the electroconductive finely divided particles comprise a metal or a metal alloy, excessively large particle size of the electroconductive finely divided particles may result in die galling. A more preferable range for the average particle size of the electroconductive finely divided particles is from 1.2 to 1.6 folds of the dry film thickness.

The electroconductive finely divided particles may be added to the coating composition in an amount of from 1.0 to 40 parts by weight per 100 parts by weight of the organic resin. When the amount of the electroconductive finely divided particles is less than 1.0 part by weight per 100 parts by weight of the organic resin, electroconductivity would not be sufficiently improved. An addition of more than 40 parts by weight of the electroconductive finely divided particles per 100 parts by weight of the organic resin may involve a risk of reduced adhesion of the organic resin mixture film with the underlying aluminum substrate, leading to poor corrosion resistance of the product.

The particle size of the powder lubricant and the electroconductive finely divided particles was determined by light scattering measurement or by direct microscopic observation.

The organic resin mixture film may further comprise conventional additives such as a reaction promoter, a stabilizer, and a dispersant in an amount that does not detract from the merits of the present invention.

The organic resin mixture film may be coated on a conventional line including a roll coater. The roll coater, however, may preferably have a coating pan equipped with a stirring device or a circulation device so that the precipitation of the particles in the coating composition may be prevented.

It is to be noted that a small-sized product may be produced in a laboratory using a bar coater and an oven.

The aluminum substrate may not necessarily be subjected to the above-described surface treatment on all its surface, and the aluminum substrate may be surface-treated on selected parts which may become in contact with working equipments, namely, on parts where lubricity is required. For example, when the aluminum material is a plate, it may be surface-treated either on both surfaces or on one surface.

The present invention is further described by the following Examples of the invention and Comparative Examples which by no means limit the scope of the present invention.

EXAMPLES

(1) Preparation Of the Surface-Treated Aluminum Material

Aluminum alloy substrate

A strip of an aluminum alloy 5182 having a thickness of 1 mm was used for the substrate. This is a typical material used for working. The aluminum alloy strips were degreased with trichloroethylene steam, alkali degreased in sodium phosphate, washed with water, and dried before subjecting to subsequent chromate treatment as indicated in Table 1. Some aluminum alloy strips were degreased with trichloroethylene steam, and then, instead of the alkali degreasing, surface activated with caustic soda and aqueous solution of nitric acid to remove oxide film formed on the surface before subjecting to the subsequent chromate treatment as indicated in Table 1.

Chromate film

On the aluminum alloy substrate was applied a chromate film using commercially available conversion-type chromate solutions and dry in place-type chromate solutions.

The dry in place-type chromate solution was adjusted for its concentration before its application using a roll coater to a coating weight as indicated in Table 1. Coating of the conversion-type chromate solution was carried out by dipping the substrate material for an appropriate period. The thus chromate treated substrate was dried.

Organic resin mixture film

On the thus formed chromate film was deposited an organic resin mixture film.

Ingredients of the type and the amount shown in Table 2 were mixed in a ball mill to prepare the coating composition, which was coated on the chromate film using a bar coater to a dry thickness shown in Table 2. The thus coated organic resin mixture film was dried in an oven dryer with hot air circulation.

The organic resins, the electroconductive finely divided particles, the powder lubricants, and the chromates used in the Examples of the present invention and Comparative Examples were as described below.

Organic resins

Epoxy resin

Epikote® 1007 manufactured by Petrochemical Shell Epoxy K.K.

Alkyd resin

Urix® manufactured by Mitsui Toatsu Chemicals, Inc.

Acryl resin

Almatex® 749 manufactured by Mitsui Toatsu Chemicals, Inc.

Urethane resin

Olester® manufactured by Mitsui Toatsu Chemicals, Inc.

Phenol resin

Super beckacite® manufactured by Dainippon Ink & Chemicals, Inc.

Melamine resin

Uan® manufactured by Mitsui Toatsu Chemicals, Inc.

Polyvinyl butyral resin

Denka-butyral® manufactured by Denki Kagaku Kogyo K. K.

Polyester resin

Almatex® P645 manufactured by Mitsui Toatsu Chemicals, Inc.

Epoxy resin+acryl resin

A mixture of 100 parts by weight of epoxy resin and 50 parts by weight of acryl resin.

Epoxy resin+urethane resin

A mixture of 100 parts by weight of epoxy resin and 100 parts by weight of urethane resin.

Acryl resin+urethane resin

A mixture of 100 parts by weight of acryl resin and 100 parts by weight of urethane resin.

Lubricants

Polyolefin wax: polyethylene wax

Fluororesin: poly-tetrafluoroethylene resin

A mixture of 100 parts by weight of the polyethylene wax and 100 parts by weight of the poly-tetrafluoroethylene was also used.

Electroconductive finely divided particles

Carbon: Carbon graphite, which had been adjusted for their particle size in a ball mill Metal and metal alloy particles:

Metals

Cu, Ni, Ag, Al, Zn, Cr, Fe, and Co

Metal alloys

Stainless steel: SUS 316

Brass: 7/3 brass

Cupronickel: Cu, 90 parts by weight; Ni, 10 parts by weight

Cu/Ni mixed powder : Cu, 100 parts by weight; Ni, 100 parts by weight

Cu/Al mixed powder: Cu, 100 parts by weight; Al, 50 parts by weight

Ag/Co mixed powder: Ag, 100 parts by weight; Co, 200 parts by weight

The metals and metal alloy particles were prepared by atomization followed by classification.

Mixture of carbon graphite and Ni: Carbon graphite 20 parts by weight; Ni, 80 parts by weight Chromates Conversion-type chromate A. Phosphoric acid chromate: Alchrome 3701, manufactured by Nihon Parkerizing Co., Ltd.

B. Chromic acid chromate: Alchrome 713, manufactured by Nihon Parkerizing Co., Ltd.

Dry in place-type chromate

C. Silica-free chromate: 4513H, manufactured by Nihon Parkerizing Co., Ltd.

D. Silica-containing chromate: Cosma-150, manufactured by Kansai Paint Co., Ltd.

(2) Evaluation

The resulting surface-treated aluminum alloy strips were tested and evaluated for their workability, weldability, and corrosion resistance.

Workability

Workability was evaluated in terms of limiting drawing ratio using blanks cut out of the surface-treated aluminum alloy plate. The blank was pressed at a speed of 100 mm/sec to form a cylinder having a diameter of 33 mm and a flat top surface. The evaluation was carried out with and without lubricant oil (R303P, manufactured by Sugimura Chemical Corporation, used at about 2 g/m$^2$).

The cylinder having a flat top surface formed from a blank of 66 mm diameter without using the lubricant oil was also evaluated for its appearance with naked eye. The appearance was evaluated in accordance with the following criteria.

O (good): no peeling off of the organic resin mixture film or die galling observed.

Δ (fair): peeling off of the organic resin mixture film as well as die galling were observed in some parts of the side surface of the cylinder.

X (poor): peeling off of the organic resin mixture film as well as die galling were observed throughout the side surface of the cylinder.

XX (very poor): could not be drawn and became torn.

Spot weldability

The surface-treated aluminum alloy plates were spot welded with an inverter DC welder to determine the life of the electrode in terms of the number of spot welds that could be made before deposition of the molten aluminum on the electrode tip or before decrease of the nugget diameter to 4 $\sqrt{t}$ or less (t: thickness of the sample plate). The electrode and the welding conditions employed were as described below.

Electrode

Configuration: frustoconical (CF)

Tip diameter: 5.0 mm

Material: Cr—Cu

Welding conditions

Welding force: 150 kgf

Initial pressurization time: 20/50 sec.

Welding time: 6/50 sec.

Retention time: 5/50 sec.

Welding current: 15 kA

The spot weldability was evaluated in accordance with the following criteria.

X (poor): less than 500 spots

Δ (fair): 500 to 999 spots

O (good): 1,000 to 1,499 spots

⊙ (excellent): 1,500 spots or more

Corrosion resistance

The surface-treated aluminum alloy plates were evaluated for their corrosion resistance by salt spray test, complex corrosion test, and crevice corrosion test as described below.

Salt spray test

Test specimens of 75 mm×150 mm were cut out of the surface-treated aluminum alloy plates. The test specimens were sealed on their edges, and sprayed with 5% NaCl at 35° C. for 480 hours. The specimens were evaluated by their appearance in accordance with the following criteria.

X (poor): white rust and/or blackening

O (good): no change in the appearance

Complex corrosion test

Cross-cuts were formed on the test specimens of the size identical to those used in the above-described salt spray test. The test specimens were subjected to 100 cycles of brine spraying (5% NaCl, 35° C., 4 hours), standing under moist conditions (60° C., 2 hours), and drying (relative humidity 95%, 50° C., 2 hours). The corrosion resistance was evaluated in terms of the maximum length (width) of the corrosion developed from the cross cuts in accordance with the following criteria.

O (good): less than 2 mm

X (poor): 2 mm or more

Crevice corrosion test

Two specimens of 50 mm×100 mm were spot welded to each other at their central part under the welding conditions described for the spot weldability evaluation using a new electrode. The thus welded specimens were subjected to salt spraying (5% NaCl, 35° C., 2,000 hours), and then, the welded specimens were separated from each other to evaluate the corrosion developed on the welded surface of the plates (namely, in the crevice of the welded plates). The corrosion resistance was evaluated in terms of the maximum corrosion depth in accordance with the following criteria.

O (good): less than 0.05 mm

Δ (fair): 0.05 to 0.1 mm

X (poor): 0.1 mm or more

The results of the above-described evaluations for the samples of the Examples of the invention and the Comparative Examples are shown in Table 3.

TABLE 1

| | Chromate film | | | | | | |
|---|---|---|---|---|---|---|---|
| | First major surface[a] | | | Second major surface[b] | | | |
| | Substrate | Chromate film | | Substrate | Chromate film | | |
| Sample No. | Oxide film removal | Type | Coating weight (C), mg/m² | Oxide film removal | Type | Coating weight (D), mg/m² | (C)/(D) |
| 1 | Yes | A | 5 | Yes | A | 10 | 1/2 |
| 2 | Yes | A | 5 | Yes | A | 15 | 1/3 |
| 3 | Yes | B | 10 | Yes | B | 20 | 1/2 |
| 4 | Yes | C | 40 | Yes | C | 60 | 2/3 |
| 5 | Yes | C | 40 | Yes | C | 80 | 1/2 |
| 6 | Yes | C | 30 | Yes | C | 40 | 3/4 |
| 7 | Yes | D | 60 | Yes | D | 90 | 2/3 |
| 8 | Yes | D | 30 | Yes | D | 90 | 1/3 |
| 9 | Yes | D | 15 | Yes | D | 15 | 1/1 |
| 10 | No | C | 6 | No | C | 6 | 1/1 |
| 11 | No | C | 26 | No | C | 26 | 1/1 |
| 12 | No | C | 61 | No | C | 61 | 1/1 |
| 13 | No | C | 96 | No | C | 96 | 1/1 |
| 14 | No | C | 20 | No | C | 20 | 1/1 |
| 15 | No | C | 19 | No | C | 19 | 1/1 |
| 16 | No | C | 34 | No | C | 34 | 1/1 |
| 17 | No | C | 42 | No | C | 42 | 1/1 |
| 18 | No | C | 14 | No | C | 14 | 1/1 |
| 19 | No | C | 15 | No | C | 15 | 1/1 |
| 20 | No | C | 15 | No | C | 15 | 1/1 |
| 21 | No | C | 14 | No | C | 14 | 1/1 |
| 22 | No | C | 19 | No | C | 19 | 1/1 |
| 23 | No | C | 10 | No | C | 10 | 1/1 |
| 24 | No | C | 21 | No | C | 21 | 1/1 |
| 25 | No | C | 19 | No | C | 19 | 1/1 |
| 26 | Yes | D | 15 | Yes | D | 15 | 1/1 |
| 27 | Yes | D | 15 | Yes | D | 15 | 1/1 |
| 28 | Yes | D | 20 | Yes | D | 20 | 1/1 |
| 29* | No | — | — | No | — | — | — |
| 30* | Yes | — | — | Yes | — | — | — |
| 31* | Yes | D | 105 | Yes | D | 210 | 1/2 |
| 32* | Yes | C | 2 | Yes | C | 3 | 2/3 |
| 33* | Yes | A | 15 | Yes | A | 30 | 1/2 |
| 34* | Yes | A | 15 | Yes | A | 30 | 1/2 |
| 35* | Yes | B | 15 | Yes | B | 30 | 1/2 |
| 36* | Yes | C | 20 | Yes | C | 40 | 1/2 |
| 37* | No | C | 24 | No | C | 24 | 1/1 |
| 38* | No | C | 20 | No | C | 20 | 1/1 |
| 39* | No | C | 3 | No | C | 3 | 1/1 |
| 40* | No | C | 41 | No | C | 41 | 1/1 |
| 41* | No | C | 20 | No | C | 20 | 1/1 |
| 42* | No | C | 21 | No | C | 21 | 1/1 |
| 43* | No | C | 20 | No | C | 20 | 1/1 |
| 44* | No | C | 7 | No | C | 7 | 1/1 |
| 45* | No | C | 15 | No | C | 15 | 1/1 |
| 46* | No | C | 16 | No | C | 16 | 1/1 |
| 47* | No | C | 14 | No | C | 14 | 1/1 |
| 48* | No | C | 17 | No | C | 17 | 1/1 |

*Comparative Example

[a]In spot welding, electrode is to be placed on this side.

[b]In spot welding, this is the side to be welded.

TABLE 2

| Sample No. | Organic resin | Dry film thickness (A), μm | Organic Resin mixture film: Powder lubricant type | Content, pbw | Average particle size (B), μm | (B)/(A) | Electroconductive particles type | Content, pbw | Average particle size (B), μm | (B)/(A) |
|---|---|---|---|---|---|---|---|---|---|---|
| 1 | Polyester | 0.5 | PO | 10 | 2.0 | 4 | Ni | 15 | 1.0 | 2.0 |
| 2 | Acryl | 0.5 | FR | 10 | 1.0 | 2 | Cr | 15 | 1.0 | 2.0 |
| 3 | Phenol | 1.0 | PO + FR | 10 | 6.0 | 6 | Fe | 20 | 1.0 | 1.0 |
| 4 | Melamine | 3.0 | PO | 0.5 | 6.0 | 2 | Ag | 10 | 0.6 | 2.0 |
| 5 | Epoxy | 0.05 | PO | 10 | 0.5 | 10 | Cu | 1.0 | 0.1 | 2.0 |
| 6 | Epoxy + Urethane | 0.3 | PO | 10 | 3.0 | 10 | Carbon graphite | 1.0 | 0.6 | 2.0 |
| 7 | Acryl | 0.3 | PO | 28 | 1.0 | 3.3 | Ni | 8 | 0.6 | 2.0 |
| 8 | Epoxy | 0.5 | FR | 36 | 1.0 | 2 | Al | 5 | 0.8 | 1.6 |
| 9 | Epoxy + Acryl | 1.0 | PO | 10 | 7.0 | 7 | Stainless steel | 20 | 1.5 | 1.5 |
| 10 | Epoxy | 2.8 | PO | 2 | 12 | 4.3 | Cu | 10 | 5.0 | 1.8 |
| 21 | Epoxy | 2.2 | FR | 8 | 6.2 | 2.8 | Carbon graphite + Ni | 15 | 3.3 | 1.5 |
| 22 | Epoxy | 3.0 | PO + FR | 8 | 6.2 | 2.1 | Ni | 15 | 4.5 | 1.5 |
| 23 | Acryl | 2.5 | FR | 4 | 6.0 | 2.4 | Ni | 15 | 5.0 | 2.0 |
| 24 | Urethane | 0.8 | PO | 10 | 1.1 | 1.4 | Brass | 10 | 1.1 | 1.4 |
| 25 | Polyester | 0.5 | FR | 20 | 1.0 | 2.0 | Brass | 10 | 0.9 | 1.8 |
| 26 | Phenol | 0.5 | PO + FR | 10 | 1.0 | 2 | Zn | 15 | 1.0 | 2.0 |
| 27 | Polyester | 1.0 | PO | 10 | 3.0 | 3 | Co | 20 | 1.0 | 1.0 |
| 28 | Acryl | 3.0 | PO | 0.5 | 6.0 | 2 | Ag + Co | 40 | 3.0 | 1.0 |
| 29* | — | — | — | — | — | — | — | — | — | — |
| 30* | — | — | — | — | — | — | — | — | — | — |
| 31* | Epoxy + Urethane | 0.3 | PO | 10 | 3.0 | 10 | Carbon graphite | 10 | 0.6 | 2.0 |
| 32* | Epoxy + Urethane | 0.3 | PO | 10 | 3.0 | 10 | Carbon graphite | 10 | 0.6 | 2.0 |
| 33* | Epoxy + Urethane | 4.0 | PO | 10 | 8 | 2.0 | Ni | 10 | 4.0 | 1.0 |
| 34* | Epoxy | 0.3 | PO | 10 | 3.0 | 10 | Carbon graphite | 0.6 | 0.6 | 2.0 |
| 35* | Epoxy | 0.3 | PO | 10 | 3.0 | 10 | Cu | 55 | 0.6 | 2.0 |
| 36* | Acryl | 0.3 | PO | 0.3 | 3.0 | 10 | Cu | 10 | 0.6 | 2.0 |
| 37* | — | — | — | — | — | — | — | — | — | — |
| 38* | Urethane | 0.03 | PO | 30 | 0.3 | 10 | Carbon graphite | 10 | 0.05 | 1.7 |
| 39* | Epoxy | 2.0 | FR | 8 | 6.2 | 3.1 | Ni | 10 | 3.2 | 1.6 |
| 40* | Polyester | 0.2 | PO | 45 | 0.7 | 3.5 | Carbon graphite | 20 | 0.3 | 1.5 |
| 41* | Acryl | 1.0 | PO | 10 | 0.7 | 0.7 | Cu | 10 | 1.5 | 1.5 |
| 42* | Urethane | 0.8 | PO | 10 | 12 | 15 | Cu | 10 | 1.4 | 1.8 |
| 43* | Urethane | 1.6 | PO | 10 | 0.7 | 0.4 | Ni | 10 | 2.0 | 1.3 |
| 44* | Epoxy | 3.8 | PO | 10 | 12 | 3.2 | Al | 10 | 6.1 | 1.6 |
| 45* | Epoxy | 0.5 | PO | 10 | 3.2 | 6.4 | Ni | 0.6 | 0.8 | 1.6 |
| 46* | Epoxy | 1.0 | FR | 10 | 6.0 | 6.0 | Ni | 50 | 1.5 | 1.5 |
| 47* | Acryl | 0.6 | FR | 10 | 3.5 | 5.8 | Al | 10 | 2.0 | 3.3 |
| 48* | Acryl | 1.1 | PO | 10 | 7.2 | 6.5 | Al | 10 | 0.6 | 0.5 |

*Comparative Example
PO: polyolefin wax
FR: fluororesin
PBW: part by weight

TABLE 3

| Sample No. | Workability Limiting draw ratio without oil | with oil | Appearance | Corrosion Resistance (A) | (B) | (C) | Weldability |
|---|---|---|---|---|---|---|---|
| 1 | 2.18 | 2.12 | ○ | ○ | ○ | ○ | ◎ |
| 2 | 2.18 | 2.12 | ○ | ○ | ○ | ○ | ◎ |
| 3 | 2.18 | 2.12 | ○ | ○ | ○ | ○ | ◎ |
| 4 | 2.12 | 2.12 | ○ | ○ | ○ | ○ | ◎ |
| 5 | 2.18 | 2.12 | ○ | ○ | ○ | ○ | ◎ |
| 6 | 2.18 | 2.12 | ○ | ○ | ○ | ○ | ◎ |
| 7 | 2.18 | 2.09 | ○ | ○ | ○ | ○ | ◎ |
| 8 | 2.18 | 2.09 | ○ | ○ | ○ | ○ | ◎ |
| 9 | 2.18 | 2.12 | ○ | ○ | ○ | ○ | ○ |
| 10 | 2.18 | 2.12 | ○ | ○ | ○ | ○ | ○ |
| 11 | 2.18 | 2.12 | ○ | ○ | ○ | ○ | ○ |
| 12 | 2.18 | 2.12 | ○ | ○ | ○ | ○ | ○ |
| 13 | 2.15 | 2.09 | ○ | ○ | ○ | ○ | ○ |
| 14 | 2.18 | 2.12 | ○ | ○ | ○ | ○ | ○ |
| 15 | 2.18 | 2.12 | ○ | ○ | ○ | ○ | ○ |
| 16 | 2.15 | 2.09 | ○ | ○ | ○ | ○ | ○ |
| 17 | 2.15 | 2.12 | ○ | ○ | ○ | ○ | ○ |

TABLE 3-continued

| Sample No. | Workability Limiting draw ratio without oil | with oil | Appearance | Corrosion Resistance (A) | (B) | (C) | Weldability |
|---|---|---|---|---|---|---|---|
| 18 | 2.18 | 2.12 | ○ | ○ | ○ | ○ | ○ |
| 19 | 2.18 | 2.12 | ○ | ○ | ○ | ○ | ○ |
| 20 | 2.18 | 2.12 | ○ | ○ | ○ | ○ | ○ |
| 21 | 2.18 | 2.12 | ○ | ○ | ○ | ○ | ○ |
| 22 | 2.18 | 2.12 | ○ | ○ | ○ | ○ | ○ |
| 23 | 2.18 | 2.12 | ○ | ○ | ○ | ○ | ○ |
| 24 | 2.18 | 2.12 | ○ | ○ | ○ | ○ | ○ |
| 25 | 2.18 | 2.12 | ○ | ○ | ○ | ○ | ○ |
| 26 | 2.18 | 2.12 | ○ | ○ | ○ | ○ | ○ |
| 27 | 2.18 | 2.12 | ○ | ○ | ○ | ○ | ○ |
| 28 | 2.18 | 2.12 | ○ | ○ | ○ | ○ | ○ |
| 29* | 1.82 | 1.91 | XX | X | X | X | Δ |
| 30* | 1.79 | 1.88 | XX | X | X | X | ○ |
| 31* | 2.18 | 2.12 | ○ | ○ | ○ | ○ | X |
| 32* | 2.12 | 2.12 | X | X | X | Δ | ○ |
| 33* | 2.12 | 2.12 | X | ○ | ○ | ○ | Δ |
| 34* | 2.18 | 2.12 | ○ | ○ | ○ | ○ | Δ |
| 35* | 2.12 | 2.12 | X | X | X | Δ | ◎ |
| 36* | 1.91 | 2.12 | X | ○ | ○ | ○ | ◎ |
| 37* | 1.85 | 1.94 | XX | X | X | Δ | Δ |
| 38* | 1.88 | 1.91 | XX | X | X | Δ | Δ |
| 39* | 1.97 | 1.94 | XX | X | X | X | ○ |
| 40* | 2.15 | 2.12 | Δ | X | X | Δ | ○ |
| 41* | 1.97 | 2.12 | Δ | ○ | ○ | ○ | ○ |
| 42* | 2.12 | 2.09 | Δ | X | X | X | Δ |
| 43* | 1.97 | 1.94 | XX | ○ | ○ | ○ | ○ |
| 44* | 2.00 | 1.97 | X | ○ | ○ | ○ | X |
| 45* | 2.15 | 2.09 | ○ | ○ | ○ | ○ | X |
| 46* | 1.88 | 1.94 | Δ | X | X | Δ | ○ |
| 47* | 1.85 | 1.91 | X | X | X | X | ○ |
| 48* | 2.15 | 2.09 | ○ | ○ | ○ | ○ | X |

Corrosion resistance:
(A) salt spray test,
(B) complex corrosion test,
(C) crevice corrosion test.
*Comparative Example The results shown in Table 3 reveal that Sample Nos. 1 to 28 of the present invention exhibit good workability, spot weldability as well as the corrosion resistance.

A particularly excellent weldability is exhibited by Sample Nos. 1 to 7 wherein the aluminum substrate has been pretreated to remove the oxide film, and wherein the chromate film has been deposited on one surface of the substrate to a coating weight equal to or smaller than ¾ of the coating weight of the chromate layer on the other surface of the substrate, when the sample specimens are welded with the welding electrode disposed on the surface having the smaller chromate coating weight.

Sample Nos. 7, 8 and 13 wherein the organic resin mixture film comprises more than 20 parts by weight of the powder lubricant exhibit slightly reduced workability when the sample is press-worked with the lubricating oil applied thereto.

On the contrary, Sample No. 29 wherein the aluminum alloy substrate has not been treated at all is poor in all of the weldability, corrosion resistance, and workability. Sample No. 30 wherein the aluminum alloy substrate has been pretreated to remove the oxide film exhibits an improved weldability. This sample, however, suffers from poor corrosion resistance and poor spot weldability since the aluminum alloy substrate has not been subjected to any further treatment.

Sample No. 31 with excessively large chromate coating weight exhibits poor weldability. Sample Nos. 32 and 39 with excessively small chromate coating weight exhibit poor corrosion resistance. These samples also suffer from insufficient workability since the adhesion of the organic resin mixture film is insufficient.

Sample Nos. 33 and 34 with excessively thick organic resin mixture film suffer from insufficient weldability, while Sample No. 38 with excessively thin organic resin mixture film suffers from insufficient weldability, corrosion resistance as well as workability.

Sample Nos. 35 and 46 with excessively large content of the electroconductive finely divided particles suffer from poor workability as well as poor corrosion resistance, while Sample Nos. 34 and 45 with excessively small content of the electroconductive finely divided particles suffer from poor weldability.

Sample No. 36 with excessively small content of the powder lubricant exhibits poor workability, and in particular, inferior workability when press-worked with no lubricating oil. Sample No. 40 with excessively large content of the powder lubricant exhibits inferior workability when press-worked using the lubricating oil. This sample also exhibits poor corrosion resistance.

Sample No. 37 which has only been subjected to the chromate treatment is poor in all of the corrosion resistance, the workability, and the spot weldability.

Sample No. 41 wherein the particle size of the lubricant is excessively small in relation to the dry film thickness of the organic resin mixture film suffers from poor workability. Sample No. 42 wherein the particle size of the lubricant is excessively large in relation to the dry film thickness of the organic resin mixture film suffers from poor corrosion resistance.

Sample No. 47 wherein the particle size of the electroconductive finely divided particles is excessively large in relation to the dry film thickness of the organic resin mixture film suffers from poor workability as well as poor corrosion resistance, whereas Sample No. 48 wherein the particle size of the electroconductive finely divided particles is too small in relation to the dry film thickness of the organic resin mixture film suffers from insufficient weldability.

As described above, the surface-treated aluminum material of the present invention, which comprises the aluminum or aluminum alloy substrate, the chromate layer disposed on the substrate, and the organic resin mixture film disposed on the chromate layer, has remarkably improved weldability, workability, and corrosion resistance. Therefore, the surface-treated aluminum material of the present invention may be reliably press-worked without using any lubricating oil, and consequently, no degreasing treatment would be required after the press-working of the material, resulting in an improved productivity as well as reduced load to the environment. Furthermore, since the surface-treated aluminum material of the present invention has an improved corrosion resistance, the crevice and hem portions formed in the welding or press working would not easily be corroded, leading to an improved stability in the quality of the product.

We claim:

1. A surface-treated aluminum material having improved spot resistance weldability, workability and corrosion resistance comprising (A) an aluminum or aluminum alloy substrate having two major surfaces;

(B) a chromate film deposited on at least one major surface of said substrate to a coating weight of from 5 to 100 mg/m$^2$ calculated in terms of elementary chromium; and (C) an organic resin mixture film deposited on the chromate film to a dry film thickness of from 0.05 to 3.0 μm, said organic resin mixture film comprising (a) 100 parts by weight of at least one organic resin selected from the group consisting of epoxy resins, alkyd resins, acryl resins, urethane resins, phenol resins, melamine resins, polyvinyl butyral resins, polyester resins, and copolymers thereof;

(b) 0.5 to 40 parts by weight based on the weight of the organic resin of at least one member selected from the group consisting of polyethylene wax and polytetrafluoroethylene resin having an average particle size of from 0.05 to 20 μm, said average particle size being in the range of from 1.0 to 10 times the dry organic film thickness; and (c) 1.0 to 40 parts by weight based on the weight of the organic resin of electroconductive finely divided particles having an average particle size in the range of from 0.05 to 5 μm, said average particle size being in the range of from 1.0 to 2 times the dry organic film thickness.

2. A surface-treated aluminum material having improved spot resistance weldability, workability with no lubricant oil and corrosion resistance comprising (A) an aluminum or aluminum alloy substrate having two major surfaces;

(B) a chromate film deposited on at least one major surface of said substrate to a coating weight of from 5 to 100 mg/m$^2$ calculated in terms of elementary chromium; and (C) an organic resin mixture film deposited on the chromate film to a dry film thickness of from 0.05 to 3.0 μm, said organic resin mixture film comprising (a) 100 parts by weight of at least one organic resin selected from the group consisting of epoxy resins, alkyd resins, acryl resins, urethane resins, phenol resins, melamine resins, polyvinyl butyral resins, polyester resins, and copolymers thereof;

(b) 2 to 40 parts by weight based on the weight of the organic resin of at least one member selected from the group consisting of polyethylene wax and polytetrafluoroethylene resin having an average particle size being in the range of from 0.05 to 20 μm, said average particle size being in the range of from 1.0 to 10 times the dry organic film thickness; and (c) 1.0 to 40 parts by weight based on the weight of the organic resin of electroconductive finely divided particles having an average particle size in the range of from 0.05 to 5 μm, said average particle size being in the range of from 1.0 to 2 times the dry organic film thickness.

3. A surface-treated aluminum material having improved spot resistance weldability, workability and corrosion resistance comprising (A) an aluminum or aluminum alloy substrate having two major surfaces;

(B) a chromate film deposited on at least one major surface of said substrate to a coating weight of from 5 to 100 mg/m$^2$ calculated in terms of elementary chromium; and (C) an organic resin mixture film deposited on the chromate film to a dry film thickness of from 0.05 to 3.0 μm, said organic resin mixture film comprising (a) 100 parts by weight of at least one organic resin selected from the group consisting of epoxy resins, alkyd resins, acryl resins, urethane resins, phenol resins, melamine resins, polyvinyl butyral resins, polyester resins, and copolymers thereof;

(b) 0.5 to 20 parts by weight based on the weight of the organic resin of at least one member selected from the group consisting of polyethylene wax and polytetrafluoroethylene resin having an average particle size of from 0.05 to 20 μm, said average particle size being in the range of from 1.0 to 10 times the dry organic film thickness; and (c) 1.0 to 40 parts by weight based on the weight of the organic resin of electroconductive finely divided particles having an average particle size in the range of from 0.05 to 5 μm, said average particle size being in the range of from 1.0 to 2 times the dry organic film thickness.

4. The surface-treated aluminum material of claim 2 wherein the electroconductive finely divided particles (c) are at least one member selected from the group consisting of copper, nickel, silver, aluminum, zinc, chromium, iron, cobalt, alloys thereof, and carbon graphite.

* * * * *

UNITED STATES PATENT AND TRADEMARK OFFICE

CERTIFICATE OF CORRECTION

PATENT NO. : 5,395,687

DATED : March 7, 1995

INVENTOR(S) : TOTSUKA, et al

It is certified that error appears in the above-identified patent and that said Letters Patent is hereby corrected as shown below:

On title page, item [30] , change the third priority serial number from "3-320425" to -- 4-320425 --

Signed and Sealed this

Sixteenth Day of May, 1995

*Attest:*

*Attesting Officer*

Bruce Lehman

BRUCE LEHMAN

*Commissioner of Patents and Trademarks*